US009751595B2

(12) United States Patent
Fitch

(10) Patent No.: US 9,751,595 B2
(45) **Date of Patent: *Sep. 5, 2017**

(54) ANCHOR POSITIONING SYSTEM

(71) Applicant: FE ANCHOR CORPORATION, Victoria (SC)

(72) Inventor: Edmund Fitch, East Sussex (GB)

(73) Assignee: FE ANCHOR CORPORATION, Victoria, Seychelles (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/719,123

(22) Filed: May 21, 2015

(65) Prior Publication Data

US 2015/0336638 A1 Nov. 26, 2015

Related U.S. Application Data

(63) Continuation of application No. 13/263,288, filed as application No. PCT/GB2010/000719 on Apr. 8, 2010, now Pat. No. 9,061,741.

(30) Foreign Application Priority Data

Apr. 8, 2009 (GB) ..... 0906182.1
Nov. 18, 2009 (GB) ..... 0920221.9

(51) Int. Cl.
*B63B 21/24* (2006.01)
*B63B 21/50* (2006.01)
*B63B 21/22* (2006.01)

(52) U.S. Cl.
CPC ..... *B63B 21/50* (2013.01); *B63B 21/22* (2013.01); *Y10T 24/45984* (2015.01)

(58) Field of Classification Search
CPC ..... B63B 21/50; B63B 21/26; B63B 21/24; B63B 21/46; B63B 21/38; B63B 21/22
(Continued)

(56) References Cited

U.S. PATENT DOCUMENTS 2,413,596 A 12/1946 Wood, Jr.
4,098,216 A 7/1978 Bruce
(Continued)

FOREIGN PATENT DOCUMENTS

CN 86100338 8/1987
DE 8518936 8/1985
(Continued)

OTHER PUBLICATIONS

International Search Report and Written Opinion prepared by the European Patent Office on Nov. 17, 2010, for International Application No. PCT/GB2010/000719.
(Continued)

*Primary Examiner* — Anthony Wiest
(74) *Attorney, Agent, or Firm* — Sheridan Ross PC

(57) ABSTRACT

An anchor and an anchor positioning system are provided in which an anchor shackle is arranged such that, in use, it is disposed within a chasing collar. The anchor shackle can be positioned in a locking position in the chasing collar in which rotational movement of the anchor shackle around its longitudinal axis is inhibited. The anchor shackle may also be positioned in an unlocked position in the chasing collar. The anchor shackle can rotate around its longitudinal axis from the unlocked position to the locking position. Accordingly, the anchor shackle assists in maintaining the anchor in a desired orientation corresponding to the locking position.

20 Claims, 7 Drawing Sheets

(58) Field of Classification Search
USPC ..... 114/293, 294, 295, 297, 299; 24/700
See application file for complete search history.

(56) References Cited

U.S. PATENT DOCUMENTS

| | | | |
|---|---|---|---|
| 4,230,062 | A | 10/1980 | Fornasiero |
| 4,724,789 | A | 2/1988 | van den Haak |
| 4,869,193 | A | 9/1989 | van den Haak |
| 9,061,741 | B2 | 6/2015 | Fitch |

FOREIGN PATENT DOCUMENTS

| | | |
|---|---|---|
| EP | 0049544 | 4/1982 |
| EP | 0220758 | 5/1987 |
| GB | 2174055 | 10/1986 |
| JP | S62-110591 | 5/1987 |
| WO | WO 01/81161 | 11/2001 |
| WO | WO 2007/107699 | 9/2007 |

OTHER PUBLICATIONS

Official Action for U.S. Appl. No. 13/263,288 mailed Nov. 22, 2013, 10 pages.
Official Action for U.S. Appl. No. 13/263,288, mailed Jun. 26, 2014 9 pages.
Notice of Allowance for U.S. Appl. No. 13/263,288, mailed Feb. 17, 2015 7 pages.

ANCHOR POSITIONING SYSTEM

CROSS REFERENCED TO RELATED APPLICATIONS

This application is a continuation of U.S. patent application Ser. No. 13/263,288, filed Dec. 13, 2011, which is a national stage application under 35 U.S.C. 371 of PCT Application No. PCT/BG2010/000719 having an international filing date of 8 Apr. 2010, which designated the United States, which PCT application claims the benefit of Great Britain Application No. 0906182.1 filed 8 Apr. 2009 and Great Britain Application No. 0920221.9 filed 18 Nov. 2009, the entire disclosure of each are incorporated by reference herein.

FIELD OF THE INVENTION

The present invention relates to the retention of anchors. In particular, but not exclusively, the present invention relates to the handling of anchors used for deep sea operations.

BACKGROUND TO THE INVENTION

Anchors are well known for mooring vessels at sea. Modern applications have brought new challenges to anchor technology and handling in recent years.

In particular, there is a desire to moor vessels in ever-deeper seas. One industry in which this is particularly important is offshore oil exploration. Although offshore oil platforms sometimes rest directly on the sea bed, this is often impractical. For example, in extremely deep water it is simply not possible to construct an adequate structure of this type, and even where it is possible, it may be prohibitively expensive to do so for speculative drilling projects.

As such, a number of anchored vessels are used for offshore exploration. Semisubmersible platforms are an example of vessels used for this purpose. Semisubmersible platforms have a superstructure that is supported by columns sitting on hulls or pontoons submerged in the water below. Typically, the hulls or pontoons are ballasted with seawater. This design provides excellent stability in rough seas.

A semisubmersible platform supports sufficient machinery and personnel to carry out drilling in deep water, sometimes up to 10,000 meters. There are often 100 or more persons onboard at any given time. These structures are therefore large and the difficulties in ensuring their adequate mooring at such depths are significant.

Semisubmersible platforms are typically supported by eight large anchors, two attached to each corner of the platform by mooring lines. The anchors have fixed flukes and high holding powers. It is not possible for the semisubmersible platform itself to deploy these anchors correctly. This task is instead performed by auxiliary vessels known as anchor handling vessels (AHVs).

AHVs are required both to lay the anchors when the semisubmersible platform is moored and to recover them safely when it is desired to move the platform. Given that a typical anchor used for this purpose may weigh 15,000 kilograms and have dimensions of 8 meters by 7 meters by 6 meters, it is clear that the manipulation of these is not trivial.

In order to control these anchors, AHVs typically use a chaser which consists of a chasing collar surrounding the mooring line and a chaser line extending from the chasing collar. When the anchor is lifted from or lowered into the sea, the chasing collar is disposed around an anchor shackle on the anchor and the chaser line is pulled in or released by the AHV to control the height of the anchor.

A difficulty occurs when it is desired to remove the anchor from the water. Specifically, it is difficult to control the orientation of the anchor as it emerges from the water. Given the size and weight of the anchor, and its design to penetrate surfaces, this risks damage to the machinery used to remove the anchor and the vessels in the vicinity. Moreover, it can also risk damage to the anchor itself.

Control of the anchor's orientation is also important in a number of other anchor handling processes.

International patent application WO 2007/107699 describes an anchor system which is intended to assist in the maintenance of a desired orientation of an anchor. In particular, a chaser stopper is provided in the form of a substantially triangular plate. A chaser has a substantially elliptical aperture for receiving the chaser stopper. As such, if the chaser stopper is pulled tight into the chaser such that the plane of the plate lies along the major axis of the aperture it is not possible for the chaser stopper to rotate. However, this allows the chaser stopper to be retained in two orientations: a desired orientation; and an undesired orientation which is 180 degrees rotated from the desired orientation. Accordingly, the chaser stopper may cause the anchor to become stuck in an undesired orientation.

There exists, therefore, a need to provide assistance for the control of anchors as they are manipulated.

SUMMARY OF THE INVENTION

According to a first aspect of the present invention, there is provided an anchor positioning system, comprising:

an anchor shackle for an anchor, the anchor shackle having a longitudinal axis; and a chasing collar arranged to receive the anchor shackle in a locking position in which rotational movement of the anchor shackle around the longitudinal axis is inhibited, the chasing collar further being arranged to receive the anchor shackle in an unlocked position; wherein the anchor shackle can rotate around its longitudinal axis from the unlocked position to the locking position.

The present invention provides a system that at least in preferred embodiments may help to control the rotation of an anchor. In particular, an anchor shackle can be received in a chasing collar in both a locking position and an unlocked position. When in the locking position, rotational movement of the anchor shackle around its longitudinal axis is inhibited, while the anchor shackle can rotate around its longitudinal axis from the unlocked position to the locking position. As such, the anchor shackle can rotate to the locking position but cannot rotate away from it. Therefore, if the anchor shackle is received initially in an undesired orientation (the unlocked position) it can rotate to a desired orientation (the locked position), but cannot then rotate away from the desired orientation.

The anchor shackle can rotate from the unlocked position to the locking position with no or substantially no movement along its longitudinal axis. Accordingly, the anchor shackle does not need to move along its longitudinal axis to rotate from the unlocked position to the locking position. As a result, the anchor shackle may remain in position within the chasing collar at all times during the rotation between the unlocked position and the locking position.

Preferably, the anchor shackle comprises a curved surface for facilitating rotation of the anchor shackle around its longitudinal axis to its locking position. A curved surface assists in allowing the anchor shackle to rotate. In particular, it is relatively easy for the anchor shackle to rotate when the curved surface of the anchor shackle rests against the chasing collar. The curved surface is curved around the longitudinal axis of the anchor shackle. Accordingly, a cross section of the anchor shackle perpendicular to the longitudinal axis may be substantially constant along the longitudinal axis.

Preferably, the anchor shackle comprises a keyed portion cooperable with the chasing collar to inhibit rotational movement of the anchor shackle around its longitudinal axis when the anchor shackle is in the locking position. The keyed portion of the anchor shackle can cooperate with a corresponding portion of the chasing collar so as to inhibit rotational movement of the anchor shackle.

For example, in preferred embodiments the keyed portion comprises a protuberance defining two faces inclined at an angle relative to one another. The protuberance can be received in a recess in the chasing collar, thereby acting to inhibit rotational movement of the anchor shackle when it is in the locking position.

The protuberance may comprise two faces which are substantially planar, or have a relatively large radius of curvature. Preferably, the angle between the faces is between 90° and 180°. More preferably, the angle is between 90° and 150° C. In a preferred embodiment, the angle is 90° C. These angles provide an effective design which satisfactorily inhibits rotation of the anchor shackle when in the locking position.

Although the preferred embodiments of the present invention provide a protuberance on the anchor shackle to be received in the profile of the chasing collar, alternative mechanisms for inhibiting rotational movement may also be used. For example, the protuberance may be disposed on the chasing collar, with the anchor shackle being profiled to receive it. Moreover, inhibition of rotational movement of the anchor shackle may be achieved without a protuberance at all but by some other means, whether via complementary shapes of the anchor shackle and the chasing collar or not.

In preferred embodiments, the anchor shackle comprises both a curved surface and a protuberance. The overall cross section of the anchor shackle perpendicular to its longitudinal axis in these embodiments is therefore cam-shaped. This cross section may also be described as teardrop-shaped. The cross section consists of a rounded portion (arising from the curved surface) connecting two substantially straight edges which join at an angle.

In preferred embodiments, the anchor has a weight distribution arranged to bias the anchor shackle to rotate from the unlocked position to the locking position. Accordingly, the anchor shackle will tend to the locking position. As rotational movement of the anchor shackle from the locking position is inhibited it will then be retained in this position.

Preferably, the system further comprises an anchor body pivotally mounted to the anchor shackle. Preferably, the pivotal movement of the anchor body is limited to ensure that the anchor has a weight distribution arranged to bias the anchor shackle to rotate from the unlocked position to the locking position.

According to a second aspect of the present invention, there is provided an anchor positioning system, comprising:

an anchor shackle for an anchor; and a chasing collar for receiving the anchor shackle; wherein the chasing collar is suitable for receiving the anchor shackle in a locking position in which rotational movement of the anchor shackle is inhibited.

The present invention provides a system that at least in preferred embodiments may help to control the rotation of an anchor. To do so, the anchor shackle is placed in a locking position within the chasing collar which inhibits rotation of the anchor shackle relative to the chasing collar, and thereby that of the anchor, away from a desired orientation. In particular, rotational movement of the anchor shackle about its longitudinal axis is inhibited when in the locking position. This minimises the risk that the anchor will leave the desired orientation while it is positioned.

Preferably, in use the locking position locates the anchor shackle at the bottom of the chasing collar.

Preferably, the anchor shackle is movable to an unlocked position within the chasing collar in which rotational movement of the anchor shackle is enabled. This means that the chasing collar may receive the anchor shackle in an undesired orientation, but that from this position the anchor shackle may rotate towards the locking position and the desired orientation. This rotation of the anchor shackle occurs about its longitudinal axis. As such, if the anchor is not in the desired orientation it may rotate into the desired orientation. Once in the desired orientation, the anchor may not rotate further as the anchor shackle will be in the locking position.

The chasing collar and the anchor shackle could be provided with substantially planar surfaces which abut each other in said locking position. In use, the weight of the anchor would help prevent rotation of the anchor shackle relative to the chasing collar from this position.

In a preferred embodiment, the anchor shackle comprises a protuberance and a section of the chasing collar is profiled to receive said protuberance when the anchor shackle is in said locking position. In this example, the combination of the protuberance and the profile of the chasing collar acts to inhibit rotational movement of the anchor shackle when in the locking position.

Preferably, the protuberance defines two faces inclined at an angle relative to each other. These faces may be substantially planar, or have a relatively large radius of curvature. Preferably, the angle between the faces is between 90° and 180°. More preferably, the angle is between 90° and 150° C. In a preferred embodiment, the angle is 90° C. These angles provide an effective design which satisfactorily inhibits rotation of the anchor shackle when in the locking position.

Although the preferred embodiment of the present invention provides a protuberance on the anchor shackle to be received in the profile of the chasing collar, alternative mechanisms for inhibiting rotational movement may also be used. For example, the protuberance may be disposed on the chasing collar, with the anchor shackle being profiled to receive it. Moreover, inhibition of rotational movement of the anchor shackle may be achieved without a protuberance at all but by some other means, whether via complementary shapes of the anchor shackle and the chasing collar or not.

Preferably, the anchor shackle further comprises a substantially curved surface for facilitating rotation of the anchor shackle towards said locking position. This curved surface helps to facilitate rotational movement of the anchor shackle within the chasing collar about its longitudinal axis. In particular, it is relatively easy for the anchor shackle to rotate when the curved surface of the anchor shackle rests against the chasing collar.

In preferred embodiments, the anchor shackle comprises both a curved surface and a protuberance. The overall cross section of the anchor shackle in these embodiments is cam-shaped. This cross section may also be described as teardrop-shaped. The cross section consists of a rounded portion (arising from the curved surface) connecting two substantially straight edges which join at an angle.

According to a third aspect of the present invention, there is provided a chasing collar for receiving an anchor shackle of an anchor, the chasing collar comprising:

attachment means for attaching a chasing line; and a keyed portion cooperable with the anchor shackle to inhibit rotational movement of the anchor shackle.

The chasing collar of this aspect can be used to help ensure that an anchor is retained in a desired orientation by inhibiting rotational movement of the anchor's anchor shackle.

Preferably, the attachment means and the keyed portion are diametrically opposed to each other. This means that when tension is applied to the chasing line the anchor shackle is forced against the keyed portion, thereby helping to ensure that rotational movement of the anchor shackle is inhibited.

According to a fourth aspect of the present invention, there is provided an anchor shackle for an anchor, the anchor shackle comprising a keyed portion cooperable with a chasing collar to inhibit rotational movement of the anchor shackle. The keyed portion of the anchor shackle is used to inhibit its rotational movement away from a desired orientation. The keyed portion of the anchor shackle preferably comprises a protuberance. Moreover, in preferred embodiments, the anchor shackle comprises a curved surface away from the keyed portion which is cooperable with the chasing collar to enable rotational movement of the anchor shackle within the chasing collar.

According to a fifth aspect of the present invention, there is provided an anchor comprising the anchor shackle of the fourth aspect.

Preferably, the centre of gravity of the anchor is offset from a longitudinal axis passing through the centre of the anchor shackle. More preferably, the anchor has a centre of gravity displaced from the centre of the anchor shackle in the direction of the keyed portion. As such, if the anchor is not in the desired orientation, the effect of gravity on the anchor will be to rotate it to the position in which the keyed portion faces downwardly. In preferred embodiments, this is the desired orientation and so gravity will help to return the anchor to the desired orientation if it is not already in it.

In a preferred embodiment, the anchor further comprises an anchor body pivotally mounted to the anchor shackle, wherein pivotal movement of the anchor body is limited to ensure that the anchor has a centre of gravity displaced from the centre of the anchor shackle in the direction of the keyed portion. In this way, the anchor body may pivot about an axis extending perpendicular to the longitudinal axis of the anchor shackle. However, pivotal movement of the anchor body is limited so that at all times the centre of gravity of the anchor is offset from the longitudinal axis of the anchor shackle at least partly in the direction of the keyed portion relative to this axis.

According to a sixth aspect of the present invention, there is provided a method of positioning an anchor, comprising:

locating an anchor shackle of the anchor in a locking position in a chasing collar;

guiding the anchor to a desired location using a chasing line attached to the chasing collar; wherein tension is maintained in the chasing line to retain the anchor shackle in the locking position and thereby to inhibit rotational movement of the anchor shackle.

The sixth aspect provides a method of positioning an anchor in which placement of the anchor's anchor shackle in a particular locking position in the chasing collar prevents unwanted rotation of the anchor about the longitudinal axis of the anchor shackle.

According to a seventh aspect of the present invention, there is provided an anchor comprising:

an anchor shackle; and an anchor body pivotally mounted to the anchor shackle, wherein pivotal movement of the anchor body relative to the anchor shackle is limited to ensure that the centre of gravity of the anchor remains offset from a first surface of the anchor shackle in a given direction.

The arrangement of the seventh aspect assists in returning an anchor to a position in which a first surface of an anchor shackle faces downwardly, as the action of gravity will provide a turning moment to this effect if the lower surface of the anchor shackle is supported. As such, the anchor may be arranged to automatically return to a preferred or desired position.

BRIEF DESCRIPTION OF THE DRAWINGS

Preferred embodiments of the present invention will now be described by way of example only with reference to the accompanying drawings, in which.

DETAILED DESCRIPTION

Figure 1:
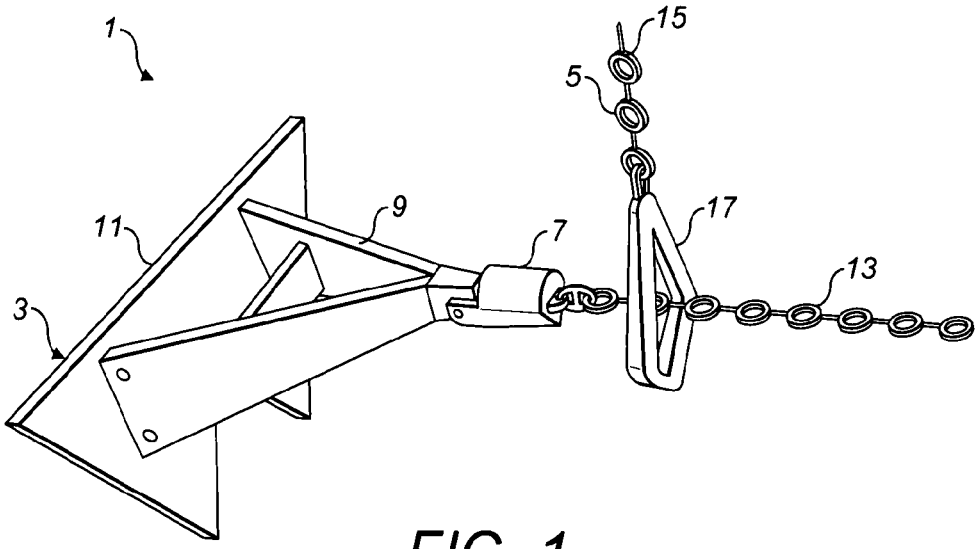
FIG. 1 illustrates the anchor positioning system of a first embodiment.

An anchor positioning system 1 according a first embodiment of the present invention will now be described. As illustrated in FIG. 1, the anchor positioning system 1 includes an anchor 3 and a chaser 5. The anchor 3 comprises an anchor shackle 7 mounted to one end of an anchor body 9. A set of flukes 11 are attached to the other end of the anchor body 9. The anchor shackle 7 is also attached to a mooring line 13 to connect the anchor 3 to the vessel which is to be moored (not shown). In the following example this vessel is a semisubmersible oil rig, but one skilled in the art will recognise that other vessels may make use of the present invention. The flukes 11 of the anchor 3 have penetrating edges used to penetrate the sea floor as required. The flukes 11 are set in a fixed orientation to the anchor body 9.

The chaser 5 comprises a chaser line 15 and a chasing collar 17. The chasing collar 17 is arranged to encircle the anchor shackle 7 when it is desired to manipulate the anchor 3. Manipulation of the anchor 3 is carried out by an anchor handling vessel (AHV) 23 connected to the far end of the chaser line 15.

In the illustrated embodiment, the mooring line 13 is a chain and the chaser line 15 consists of wire rope. However, one skilled in the art will recognise that other materials may be used for this purpose. Similarly, both mooring line 13 and chaser line 15 may be formed of a combination of materials. For example, a chaser line 15 may consist predominantly of wire rope but include a length of chain adjacent to the chasing collar 17. This arrangement allows the AHV 23 to grip the chain when the anchor is on board, enabling the wire rope section of the chasing line 15 to be replaced.

Figure 2A:
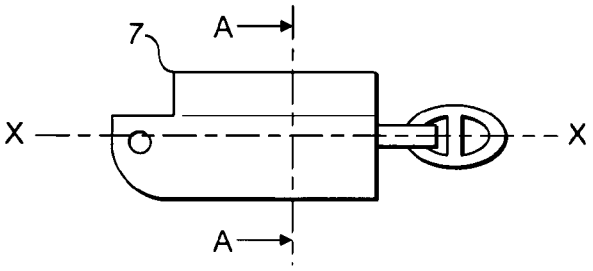
FIG. 2A shows a side view of the anchor shackle of the first embodiment.
Figure 2B:
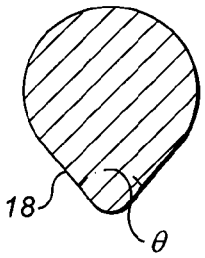
FIG. 2B shows the cross section of the anchor shackle through the line A-A shown in FIG. 2A.
Figure 2C:
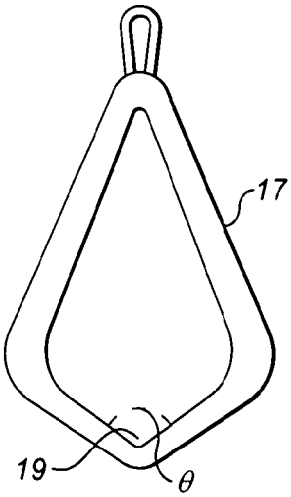
FIG. 2C shows the chasing collar of the first embodiment.

The anchor shackle 7 and the chasing collar 17 have complementary cross sections, as illustrated in FIGS. 2A to 2C. FIG. 2A shows a side view of the anchor shackle 7 and indicates a line A-A through which the cross section shown in FIG. 2B is drawn. FIG. 2A also indicates the longitudinal axis X-X of the anchor shackle.

As shown in FIG. 2B, the cross section of the anchor shackle 7 through the line A-A can be considered in two parts. The cross section is substantially perpendicular to the longitudinal axis X-X. The cross section comprises a substantially rounded portion (the upper portion of the cross section as shown in the Figure) and a locking portion consisting of two straight edges joined at an angle θ. The anchor shackle therefore comprises a substantially curved surface (accounting for the rounded portion of the cross section) and a protuberance 18 having two substantially planar faces (which accounts for the linear portion). The cross section therefore defines a two dimensional shape having a single corner. This shape may be described as cam-shaped or teardrop-shaped.

FIG. 2C illustrates the chasing collar 17, including the hole through which the mooring line 13 and the anchor shackle 7 may extend. As can be seen in the Figure, the lower half (from the point of view shown in the Figure) of the hole is designed to cooperate with the protuberance 18 of the anchor shackle 7. In particular, the chasing collar is profiled to include a tapered recess 19 which forms an apex with an angle θ substantially equal to the angle θ provided at the corner of the anchor shackle's 7 protuberance 18. The cooperative areas of the anchor shackle 7 and the chasing collar 17 (that is, the protuberance 18 and the recess 19 respectively) can be thought of as keyed portions As such, when the anchor shackle 7 is placed in the chasing collar 17 in such an orientation that the protuberance 18 of the anchor shackle 7 and the recess 19 of the chasing collar 17 coincide, rotational movement of the anchor shackle 7 relative to the chasing collar 17 is inhibited. This position is referred to hereinafter as the locking position. However, rotational movement of the anchor shackle 7 relative to the chasing collar 17 is possible when the protuberance 18 is not disposed within the recess 19. Therefore, it is possible for relative rotational movement of the anchor shackle 7 and the chasing collar 17 to bring them to a particular relative orientation (the locking position), but it is not possible for rotational movement to move them away from this orientation.

Although not shown, the chasing collar 17 may include a rotating portion at the recess 19. This rotating portion would be arranged to assist in the smooth passing of wire rope sections of the mooring line 13 by rotating as the mooring line 13 passes through the chasing collar 17.

Figure 3:
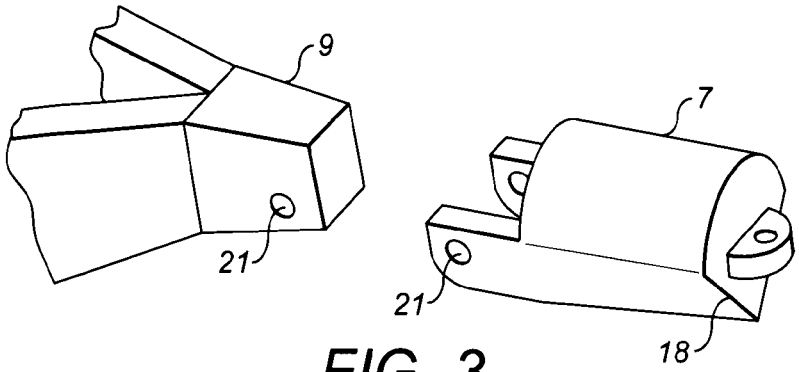
FIG. 3 illustrates the connection of the anchor shackle to the anchor body in the first embodiment.

FIG. 3 illustrates the connection of the anchor shackle 7 to the anchor body 9. For illustrative purposes, these two features are shown disconnected, though in use the anchor shackle 7 is mounted on the anchor body 9.

The anchor shackle 7 is pivotally mounted to the anchor body 9 around a pivot pin 21. As can be seen from FIG. 3, the pivot pin 21 is offset relative to a central axis of both the anchor shackle 7 and the anchor body 9. This prevents relative pivotal movement of the anchor body 9 and the anchor shackle 7 in a first direction beyond a point at which end portions of these features abut each other, while relative pivotal movement of the anchor body 7 and the anchor shackle 9 away from this point is possible. As can be seen in the Figure, the consequence of this is that it is possible for the distal end of the anchor body 9 to pivot downwardly (the anti-clockwise direction with the respect to the view shown in the Figure) in the direction of the protuberance 18 of the anchor shackle 7. However, it is not possible for the anchor body 9 to pivot upwardly (the clockwise direction shown in the figure) away from the protuberance 18. The limited movement of the anchor body 9 relative to the anchor shackle ensures that the centre of gravity of the anchor 3 as a whole remains displaced from the centre of the anchor shackle 7 in the direction of the protuberance 18. The centre of the anchor shackle 7 typically lies on the longitudinal axis X-X of the anchor shackle 7. As explained below, this ensures that in use gravity causes the anchor 3 to always return to the desired locking position when disposed in the chasing collar 17. That is to say, the anchor has a weight distribution arranged to bias the anchor shackle to rotate from the unlocked position to the locked position.

Figure 4A:
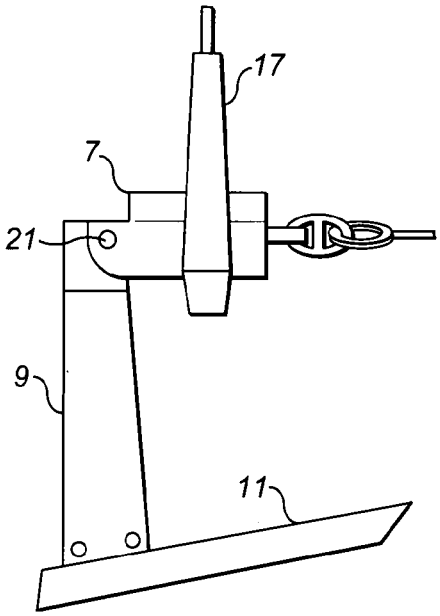
FIG. 4A shows the anchor and the chasing collar of the first embodiment in a desired relative orientation.
Figure 4B:
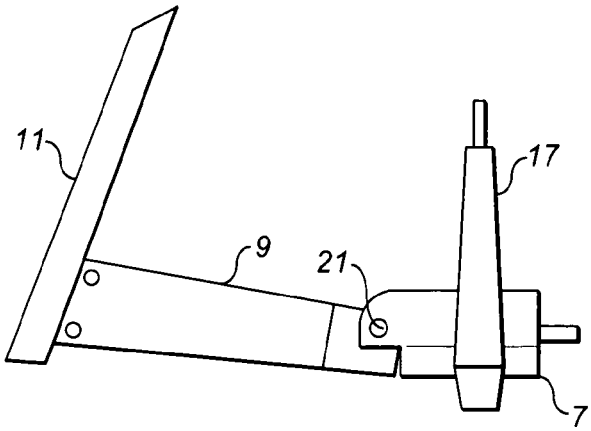
FIG. 4B shows the anchor and the chasing collar of the first embodiment in an undesired relative orientation.

FIGS. 4A and 4B show the anchor 3 and the chasing collar 17 in a desired and an undesired relative orientation respectively. As mentioned above, in use the action of gravity is a significant factor. For this reason, FIGS. 4A and 4B are illustrated in the orientation in which the system is intended for use. Moreover, in the following description the terms up, down, upward, downward, upwardly, downwardly, above, below and variations thereof are used with reference to the orientation of features as shown in the Figures.

In the desired relative orientation shown in FIG. 4A, the protuberance 18 of the anchor shackle 7 is disposed within the recess 19 of the chasing collar 17. As mentioned previously, the placement of the anchor shackle in the locking position (in which the protuberance 18 is in the recess 19) is effective to inhibit relative rotational movement of the anchor 3 and chasing collar 17 away from this relative orientation. As such, the desired orientation is maintained by these features. Moreover, gravity is effective both to ensure that the protuberance 18 remains in the recess 19 and to cause the anchor body 9 to pivot downwardly. The pivoting of the anchor body 9 in this way allows the chasing collar 17 to held in a more upright position around the anchor shackle 7, and also moves the centre of gravity of the anchor 3 further in the direction of the protuberance 18, thereby further inhibiting rotation of the anchor 3 relative to the chasing collar 17.

FIG. 4B shows the chasing collar 17 and the anchor 3 in an undesired relative orientation. In this orientation, the protuberance 18 of the anchor shackle 7 is disposed away from the recess 19 of the chasing collar 17. Moreover, the anchor body 9 is unable to pivot downwardly with respect to the anchor shackle 7 due to the abutment of the end portions of the anchor body 9 and the anchor shackle 7. As the flukes 11 of the anchor 3 are disposed in the direction of the of the protuberance 18 of the anchor shackle 7, the centre of gravity of the anchor 3 as a whole is above the point or points at which the anchor shackle 7 is resting on the chasing collar 17.

The position shown in FIG. 4B is unstable. Firstly, it will be recalled that rotational movement of the anchor shackle 7 in the chasing collar 17 is possible because the protuberance 18 of the anchor shackle 7 is not disposed within the recess 19 provided in the chasing collar 17. Moreover, the fact that the centre of gravity of the anchor 3 is displaced from the point around which the anchor shackle pivots in the manner described above means that not only is relative rotational movement of the anchor 3 possible, but also that the mass of the anchor 3 exerts a turning moment around the longitudinal axis of the anchor shackle 7 that encourages this rotation.

As a result, the anchor 3 will tend to move to the position shown in FIG. 4A from the position shown in FIG. 4B, and once in the position shown in FIG. 4A will remain there. Accordingly, manipulation of the anchor 3 can be carried out in the knowledge that its relative position with respect to the chasing collar 17 is known. This provides significant advantages in the handling of the anchor 3, as demonstrated in the examples of anchor handling operations shown in FIGS. 5 and 6.

Figure 5A:
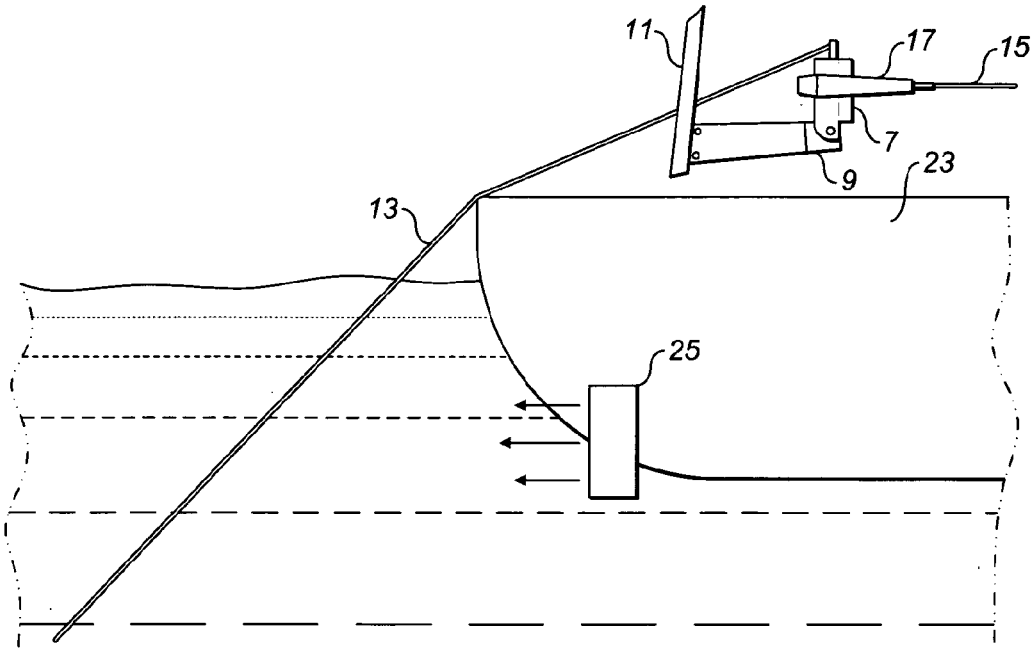
FIGS. 5A to 5C illustrate positions of the anchor during deployment and retrieval.
Figure 5B:
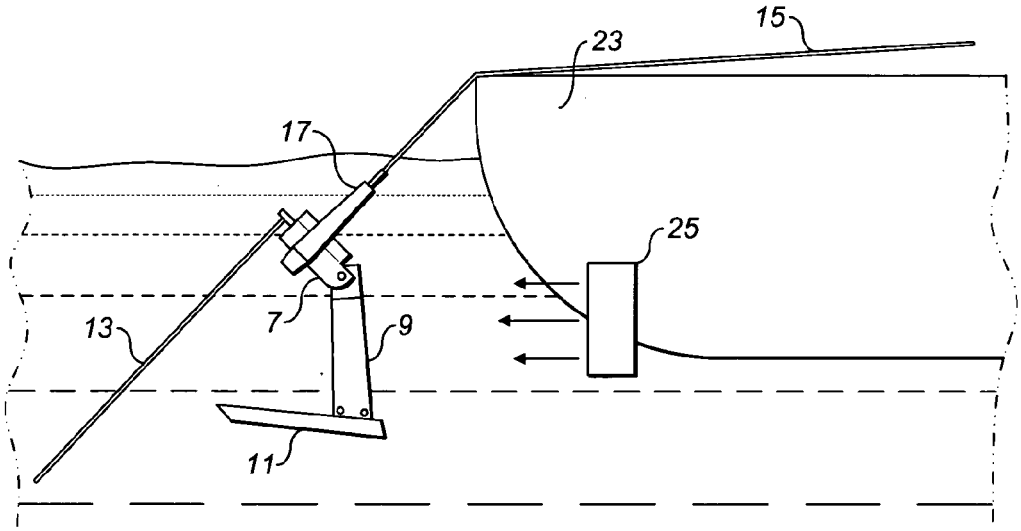
Figure 5C:
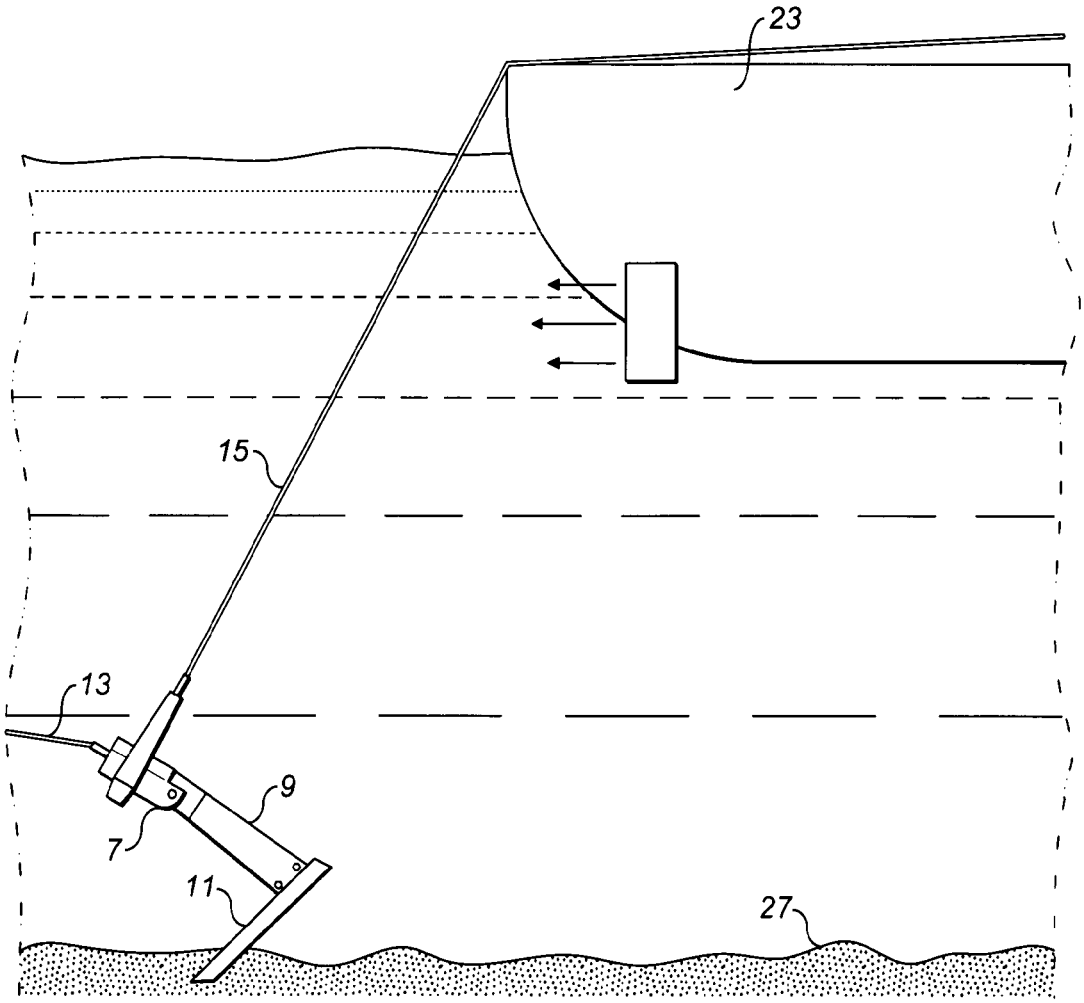

FIGS. 5A to 5C illustrate the steps taken to deploy an anchor 3.

Initially, as shown in FIG. 5A, the anchor 3 is stored upon an anchor handling vessel (AHV) 23. The mooring line 13 extends between the flukes 11 of the anchor 3 to the rig (not shown).

As shown in FIG. 5B, the anchor 3 is then released from the AHV 23. The AHV 23 controls the anchor 3 by extending the chaser line 15 and adjusting its own thrust to ensure the correct amount of tension. As the anchor 3 passes the AHV's propeller 25 there existed a risk in prior art systems that turbulence could cause the anchor 3 to rotate from the preferred position. Prior art approaches therefore required the propeller to be stopped during this period. However, this creates difficulties in ensuring adequate tension in the chaser line 15. If the required tension in the chaser line 15 is not retained then the anchor 3 will slip down such that only the mooring line 13 is retained in the chasing collar 17. This can also lead to rotation of the anchor 3. The present invention ensures that the anchor 3 does not rotate, allowing the AHV 23 to drive the propeller 25 according to requirements and simplifying the process of lowering the anchor 3.

More generally, even when the action of the propeller 25 is not an issue, it remains a matter of some skill on the part of the AHV 23 operator to retain the correct tension in the chaser line 15. There remains a risk at all times that the tension will be lost, and this will cause the anchor 3 to slip down such that it can rotate freely. However, unlike prior art anchors, the arrangement of the anchor 3 of the present invention means that in order to return the anchor 3 to the correct rotation the tension need only be restored such that the anchor shackle 7 is disposed in the chasing collar 17. Once the tension has been restored in this manner the action of gravity will cause the anchor 3 to rotate to the desired orientation (as described in the discussion relating to FIG. 4B above). In the prior art, this correction of the anchor's orientation was not possible. This is a particular issue as the AHV operator will not even know whether the anchor 3 has slipped out of position until he attempts to bed the anchor 3 in the sea floor 27.

The AHV 23 extends the chaser line 15 until the anchor 3 rests on the sea floor 27. This position is shown in FIG. 5C. The importance of retaining the anchor 3 in the desired orientation can be seen from this Figure, as this orientation ensures that the flukes 11 are directed towards the sea floor 27. If the flukes 11 were directed in an alternative orientation then they would face open sea and no possibility of penetrating the sea floor 27 would arise.

The rig then increases the tension in the mooring line 13, which drags the flukes 11 into the sea floor. The flukes 11 are designed so that once they penetrate the sea floor 27 the anchor 3 is drawn deeper into the sea bed. Once the anchor 3 is sufficiently secure, the AHV 23 brings the chasing collar 17 up the mooring line 13 towards the rig and releases the chaser line 15 with a buoy for later retrieval. At this stage, the anchor deployment process is complete.

The process of retrieving the anchor 3 is substantially similar to the deployment process carried out in reverse, starting from the position illustrated in FIG. 5C and ending at the position illustrated in FIG. 5A. The AHV 23 locates the chaser line 15 and uses this to lift the anchor 3 out of and off the sea floor 27. The AHV 23 then lifts the anchor before hauling it on board. Again, it is important that the anchor 3 remains in the desired orientation at all times. In particular, when the anchor 3 is brought onto the deck of AHV it is essential that the flukes 11 are directed away from the AHV 23. If the anchor 3 turns to an undesired orientation and the flukes 11 are directed towards the AHV 23 as they are dragged onboard then a serious potential for damage to either or both of the anchor 3 and the AHV 23 exists. The present invention minimises this risk by ensuring that the anchor 3 remains in the correct orientation while in the chasing collar 17, and moreover returns to the desired orientation should it not be in that orientation already. As was the case during deployment of the anchor 3, the present invention ensures the desired orientation even as the anchor 3 passes the propellers 25 of the AHV 23, thereby allowing power to be applied to the propellers 25 at all times.

Figure 6A:
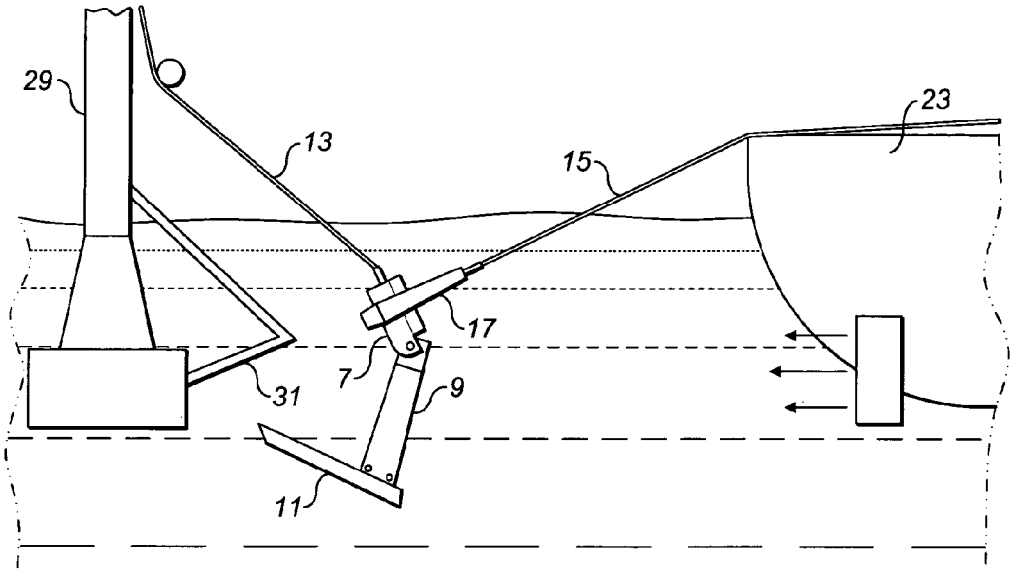
FIGS. 6A and 6B illustrate positions of the anchor when it is placed upon storage bars provided on a rig.

A final example of the manipulation of the anchor 3 is its docking for storage on storage bars 31 on the rig 29. These storage bars 31 are often referred to as cow catchers or bolsters. This is illustrated in FIGS. 6A and 6B.

Rigs 29 typically provide storage bars 31 for storing anchors 3 while the rigs 29 are in transit. In order to dock the anchor 3 on the storage bars 31, the AHV 23 must first lift it from the sea floor 27. The rig 29 then draws the mooring line 13 in, while the AHV 23 maintains tension in the chaser line 15 to ensure the correct orientation 17 of the anchor 3 and to ensure it does not return to the sea floor 27. This position is shown in FIG. 6A.

Figure 6B:
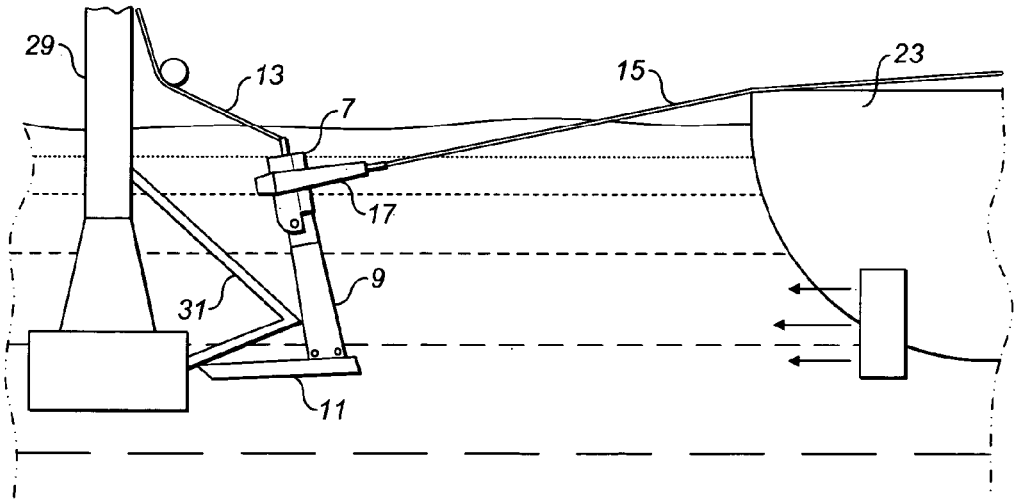

The rig 29 then draws the mooring line 13 further in until the anchor 3 rests on the storage bars 31 as illustrated in FIG. 6B. Again, it is clear that it is vital that the anchor 3 remains in the desired orientation if successful docking is to be achieved.

The present invention assists in the manipulation of anchors 3 by ensuring that their orientation can be controlled. The complementary designs of the chasing collar 17 and the anchor shackle 7 mean that a single, desired orientation can be maintained as far as possible.

The desired orientation of the anchor 3 can be lost if the chasing collar 17 slips down the mooring line 13 away from the anchor shackle 7. However, in order to regain the desired orientation the AHV 23 need only correct this error and bring the chasing collar 17 back around the anchor shackle 7. The complementary designs of the anchor shackle 7 and the chasing collar 17, and the weight distribution of the anchor 3, will then ensure that the anchor 3 rotates to the desired orientation.

Figure 7:
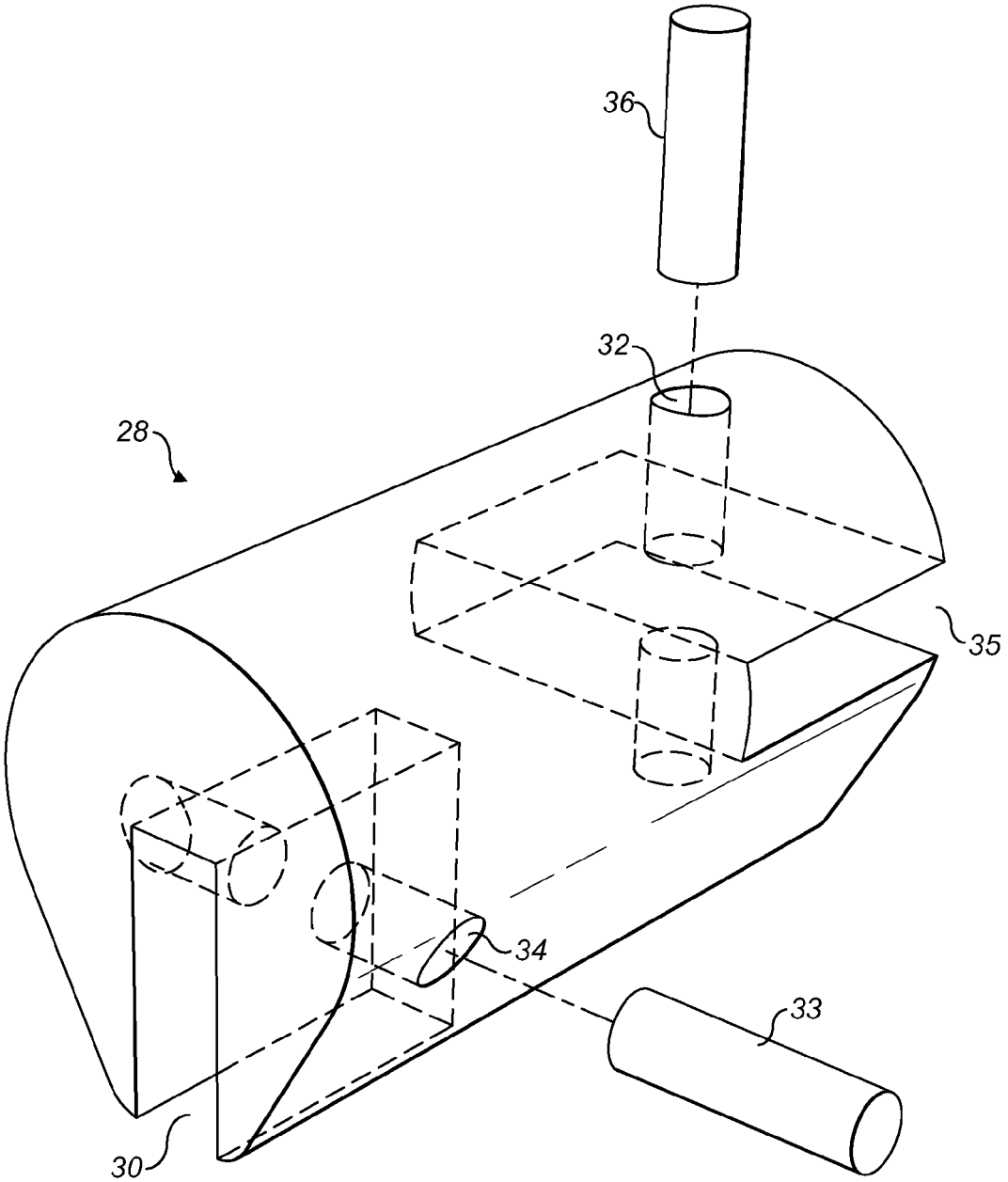
FIG. 7 illustrates the anchor shackle of the anchor positioning system according to a second embodiment of the present invention.

FIG. 7 illustrates an anchor shackle 28 of an anchor positioning system of a second embodiment of the present invention. The other features of the anchor positioning system of the second embodiment are the same as those from the first embodiment, and like reference numerals will be used to denote like features. Dotted lines are used in FIG. 7 to represent internal features of the anchor shackle 28. One skilled in the art would recognise that while these features would not in fact be visible from the angle shown in FIG. 7, their representation is useful in aiding understanding of the invention.

The anchor shackle 28 of the second embodiment operates analogously to the anchor shackle 7 of the first embodiment, and the skilled person will appreciate that description above relating to the anchor shackle 7 of the first embodiment also applies to the anchor shackle 28 of the second embodiment. In particular, the anchor shackle 28 of the second embodiment has a similar cross-sectional profile to the anchor shackle 7 of the first embodiment, allowing it to be retained in both locked and unlocked positions within the chasing collar 17 in the same manner as the anchor shackle 7 of the first embodiment. The difference between the anchor shackle 28 of the second embodiment and that of the first embodiment is found in how it couples to the chain 13 and the anchor body 9.

In particular, the anchor shackle 28 of the second embodiment is provided with a horizontal slot 35 and a vertical slot 30 for receiving the chain 13 and the anchor body 9 respectively. Once the chain 13 is in position in the horizontal slot 35 a first post 36 is introduced into the slot through a first post opening 32. The first post 36 is received through a link in the chain 13, thereby securing the chain 13 to the anchor shackle 28.

When the anchor body 9 is placed in the vertical slot 30, a second post 33 is introduced into the vertical slot through a second post opening 34. The second post 33 is received through a hole in the anchor body 9, thereby securing the anchor body 9 to the anchor shackle 28. The anchor body 9 is pivotally mounted to the anchor shackle 28 in this manner. However, the pivotal movement of the anchor body 9 relative to the anchor shackle 28 is limited by the configuration of the vertical slot 30, which only extends partway through the anchor shackle 28. This limitation of pivotal movement can be clearly seen with reference to FIGS. 8A and 8B.

The first and second posts 36, 33 may be secured in position by welding or other appropriate mechanical fastening techniques.

Figure 8A:
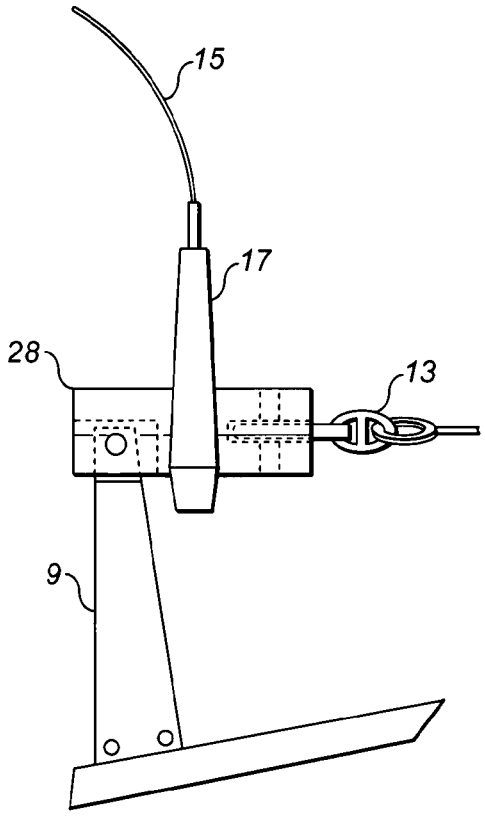
FIG. 8A shows the anchor and the chasing collar of the second embodiment in a desired relative orientation.
Figure 8B:
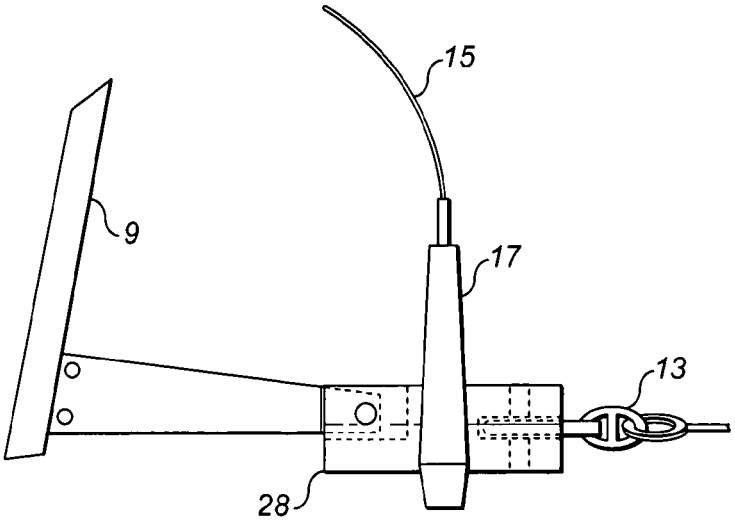
FIG. 8B shows the anchor and the chasing collar of the second embodiment in an undesired relative orientation.

FIGS. 8A and 8B show the anchor 3 and the chasing collar 17 in a desired and an undesired relative orientation respectively. FIGS. 8A and 8B are therefore equivalent to FIGS. 4A and 4B respectively, save for the replacement of the anchor shackle 7 of the first preferred embodiment shown in FIGS. 4A and 4B with the anchor shackle 28 of the second preferred embodiment shown in FIGS. 8A and 8B. Obscured elements of the anchor body 9 are shown in dotted lines in order to aid understanding. In particular, the position of the anchor body within the vertical slot 30 is shown in order to clearly illustrate the pivotal movement of the anchor body 9 relative to the anchor shackle 28.

As in the other figures, the anchor body 9 and other features illustrated in FIGS. 8A and 8B are not shown to scale.

In the desired relative orientation shown in FIG. 8A, the anchor shackle 28 is received in a locked position within the chasing collar 17 in a manner analogous to the position of the anchor shackle 7 of the first embodiment shown in FIG. 4A. This inhibits rotational movement of the anchor shackle 28 relative to the chasing collar 17. Moreover, the anchor body 9 in FIG. 8A is pivoted downwardly from the anchor shackle 28.

In the undesired relative orientation shown in FIG. 8B, the anchor shackle 28 is received in an unlocked position within the chasing collar 17 in a manner analogous to the position of the anchor shackle 7 of the first embodiment shown in FIG. 4B. This enables rotational movement of the anchor shackle 28 away from the unlocked position. Moreover, the anchor body 9 is unable to pivot downwardly with respect to the anchor shackle 28 due to the configuration of the vertical slot in the anchor shackle. This prevents the anchor body 9 from pivoting beyond a certain point.

The position of the anchor body in FIG. 8B is unstable. By limiting the pivotal movement of the anchor body 9 relative to the anchor shackle 28, the centre of gravity of the anchor 3 is maintained in such a position that the mass of the anchor 3 exerts a turning moment around the longitudinal axis of the anchor shackle 28 that encourages rotation away from the undesired orientation.

The anchor shackle 28 of the second embodiment provides the same function as the anchor shackle of the first embodiment. In particular, the anchor shackles 7, 28 of both embodiments allow limited relative pivotal movement of the anchor body 9. Similarly, the cross-sectional profiles of both anchor shackles 7, 28 are such that they may be received in a chasing collar 17 in a locked position in which rotational movement of the anchor shackle 7, 28 is inhibited and an unlocked position in which rotational movement of the anchor shackle 7, 28 is enabled.

The present invention simplifies anchor handling processes, reducing the risk of damage and increasing the speed at which operations may successfully be undertaken.

It will be appreciated that various changes and modifications may be made to the anchor positioning system disclosed herein without departing from the spirit and scope of the present invention.

The invention claimed is:

1. An anchor positioning system comprising an anchor shackle, a chasing collar and an anchor body pivotally mounted to the anchor shackle, the anchor shackle having a longitudinal axis and comprising:

a keyed portion cooperable with the chasing collar to inhibit rotational movement of the anchor shackle around the longitudinal axis when in a locking position within the chasing collar; and a surface curved around the longitudinal axis of the anchor shackle, which surface cooperates with the chasing collar to enable the anchor shackle to revolve around the longitudinal axis of the anchor shackle within the chasing collar to the locking position, wherein pivotal movement of the anchor body relative to the anchor shackle is limited to ensure the anchor body has a center of gravity offset from the longitudinal axis of the anchor shackle in the direction of the keyed portion.

2. The anchor positioning system according to claim 1, wherein the anchor shackle has a length extending in a longitudinal direction along the longitudinal axis, and wherein the keyed portion extends along the length of the anchor shackle.

3. The anchor positioning system according to claim 1, wherein the surface curved about the longitudinal axis enables the anchor shackle to revolve freely around the longitudinal axis of the anchor shackle within the chasing collar to the locking position.

4. The anchor positioning system according to claim 1, wherein the anchor shackle has a length extending in a longitudinal direction along the longitudinal axis, and wherein the surface curved around the longitudinal axis forms a curved portion extending along the length of the anchor shackle substantially parallel to the longitudinal axis.

5. The anchor positioning system according to claim 1, wherein the anchor shackle has a length extending in a longitudinal direction along the longitudinal axis, and wherein the surface curved around the longitudinal axis forms a curved portion extending along the length of the anchor shackle, where a cross-sectional profile of the anchor shackle in a cross-section perpendicular to the longitudinal axis of the anchor shackle comprises the keyed portion and the curved portion.

6. The anchor positioning system according to claim 5, wherein the curved portion and the keyed portion are on opposing sides of the cross-sectional profile of the anchor shackle in a plane perpendicular to the longitudinal axis of the anchor shackle.

7. The anchor positioning system according to claim 1, where the surface curved around the longitudinal axis is at a constant distance from the longitudinal axis.

8. The anchor positioning system according to claim 1, wherein the keyed portion comprises a protuberance.

9. The anchor positioning system according to claim 8, wherein the protuberance defines two faces inclined at an angle relative to each other.

10. The anchor positioning system according to claim 9, wherein the chasing collar is profiled to include a recess with an apex having an angle substantially equal to the angle of the protuberance such that the protuberance and the recess coincide in the locking position.

11. The anchor positioning system according to claim 1, wherein the chasing collar includes a recess having a recess profile, and the keyed portion has a keyed profile in a plane perpendicular to the longitudinal direction of the anchor shackle, where the recess profile matches the keyed profile.

12. The anchor positioning system according to claim 1, wherein the keyed portion comprises a protuberance, and the chasing collar is profiled to include a recess matching the protuberance, so that the protuberance and the recess coincide in the locking position.

13. The anchor positioning system according to claim 1, wherein the chasing collar comprises:

attachment means for attaching a chasing line; and a keyed portion cooperable with the anchor shackle to inhibit rotational movement of the anchor shackle.

14. The anchor positioning system according to claim 13, wherein the attachment means and the keyed portion are diametrically opposed to each other.

15. The anchor positioning system according to claim 1, wherein the chasing collar is arranged to receive the anchor shackle in the locking position in which rotational movement of the anchor shackle around the longitudinal axis is inhibited, the chasing collar further being arranged to receive the anchor shackle in an unlocked position; wherein the anchor shackle can rotate around the longitudinal axis from the unlocked position to the locking position with substantially no movement relative to the chasing collar along the longitudinal axis.

16. An anchor shackle configured to be pivotally mounted to an anchor body, comprising:

a longitudinal axis;

a keyed portion cooperable with a chasing collar to inhibit rotational movement of the anchor shackle around the longitudinal axis when in a locking position within the chasing collar; and a surface curved around the longitudinal axis of the anchor shackle, which surface cooperates with the chasing collar to enable the anchor shackle to revolve around the longitudinal axis of the anchor shackle within the chasing collar to the locking position, where the surface curved around the longitudinal axis is at a substantially constant distance from the longitudinal axis.

17. The anchor shackle according to claim 16, where a cross-sectional profile of the anchor shackle in a cross-section perpendicular to the longitudinal axis comprises the keyed portion and a curved portion formed by the surface curved around the longitudinal axis.

18. The anchor shackle according to claim 17, wherein the curved portion and the keyed portion are on opposing sides of the cross-sectional profile of the anchor shackle in a plane perpendicular to the longitudinal axis of the anchor shackle.

19. The anchor shackle according to claim 16, wherein the keyed portion comprises a protuberance that cooperates with a recess of the chasing collar such that the protuberance and the recess coincide in the locking position.

20. The anchor shackle according to claim 19, wherein the protuberance defines two faces inclined at an angle relative to each other.

* * * * *